US010829958B2

(12) United States Patent
Francesca

(10) Patent No.: US 10,829,958 B2
(45) Date of Patent: Nov. 10, 2020

(54) HANDLE ASSEMBLY WITH LOCK, PARTICULARLY FOR A GLASS LEAF

(71) Applicant: PBA S.P.A., Tezze sul Brenta (IT)

(72) Inventor: Masiero Francesca, Tezze sul Brenta (IT)

(73) Assignee: PBA S.P.A., Tezze sul Brenta (VI) (IT)

( * ) Notice: Subject to any disclaimer, the term of this patent is extended or adjusted under 35 U.S.C. 154(b) by 182 days.

(21) Appl. No.: 16/224,030

(22) Filed: Dec. 18, 2018

(65) Prior Publication Data

US 2019/0264467 A1 Aug. 29, 2019

(30) Foreign Application Priority Data

Feb. 23, 2018 (IT) ..... 102018000003005

(51) Int. Cl.
*E05B 63/00* (2006.01)
*E05B 65/00* (2006.01)
(Continued)

(52) U.S. Cl.
CPC ..... *E05B 63/0056* (2013.01); *E05B 1/0015* (2013.01); *E05B 9/04* (2013.01);
(Continued)

(58) Field of Classification Search
CPC .... E05B 63/0056; E05B 9/082; E05B 1/0015; E05B 65/0025; E05B 9/04; E05B 17/04;
(Continued)

(56) References Cited

U.S. PATENT DOCUMENTS 2,391,832 A * 12/1945 Johnstone ..... E05B 9/084 70/367
3,125,876 A * 3/1964 Kuchler ..... E05B 55/005 70/145
(Continued)

FOREIGN PATENT DOCUMENTS

| | | | |
|---|---|---|---|
| DE | 102015001960 | A1 | 8/2016 |
| EP | 0653533 | A1 | 5/1995 |
| EP | 2105554 | A1 | 9/2009 |
| EP | 2894283 | A1 | 7/2015 |
| WO | 2009039905 | A1 | 4/2009 |

*Primary Examiner* — Lloyd A Gall
(74) *Attorney, Agent, or Firm* — Innovation Capital Law Group, LLP; Vic Lin

(57) ABSTRACT

Described is a handle assembly (10) with lock (100), particularly for a glass leaf (200), which comprises a first fastening member (11), having a first abutment face (12) designed to make contact with a first face (201) of a leaf (200), a second fastening member (13) and a connecting mechanism (15) for mutually connecting the fastening members (11, 13).

The first fastening member (11) comprises:

- a casing (17) equipped with an operating opening (18);
- a housing (19) for a cylinder (101) of the lock (100) and equipped with a locking device (21) for blocking the cylinder (101);
- a closing element (22) movable with respect to the housing (19) between an open position and a closed position in contrast with an elastic device (23).

In the closed position of the closing element (22) it is interposed between the operating position (18) and the locking device (21) and in the open position the closing element (22) protrudes from the first abutment face (12) and it is not interposed between the operating opening (18) and the locking device (21).

8 Claims, 3 Drawing Sheets

(51) Int. Cl.

| | |
|---|---|
| ***E05B 77/44*** | (2014.01) |
| ***E05B 9/04*** | (2006.01) |
| ***E05B 9/08*** | (2006.01) |
| ***E05B 1/00*** | (2006.01) |
| *E05B 17/04* | (2006.01) |
| *E05C 9/00* | (2006.01) |

(52) U.S. Cl.
CPC ..... *E05B 9/082* (2013.01); *E05B 65/0025* (2013.01); *E05B 17/04* (2013.01); *E05B 77/44* (2013.01); *E05B 2009/046* (2013.01); *E05C 9/00* (2013.01); *E05Y 2900/132* (2013.01)

(58) Field of Classification Search
CPC .. E05B 77/44; E05B 2009/046; E05B 63/006; E05B 9/084; E05B 9/086; E05C 9/00; E05Y 2900/132
USPC ..... 70/417, 367–371, 451, 466, 224, 210, 70/215–217, DIG. 31
See application file for complete search history.

(56) References Cited

U.S. PATENT DOCUMENTS

| | | | | | |
|---|---|---|---|---|---|
| 3,919,867 | A * | 11/1975 | Lipschutz | E05B 9/084 | 70/186 |
| 3,934,437 | A * | 1/1976 | Crepinsek | E05B 55/005 | 70/370 |
| 4,202,587 | A * | 5/1980 | Wieland | E05B 9/084 | 312/219 |
| 4,679,418 | A * | 7/1987 | Allen | E05B 17/042 | 70/134 |
| 5,121,619 | A * | 6/1992 | Martin | E05B 9/084 | 70/369 |
| 5,782,119 | A * | 7/1998 | Ellis | E05B 3/003 | 70/368 |
| 2003/0121295 | A1 | 7/2003 | Lavikainen et al. | | |
| 2010/0077815 | A1 * | 4/2010 | Liu | E05B 35/00 | 70/451 |

* cited by examiner

HANDLE ASSEMBLY WITH LOCK, PARTICULARLY FOR A GLASS LEAF

This invention relates to a handle assembly with lock, particularly for a glass leaf.

More specifically, this invention relates to a handle assembly which incorporates a lock and which is particularly simple to install with respect to traditional handles.

Currently, in the sector for manufacturing handles for glass doors handles are known and valued comprising a first part, to be fixed to the outside of a door, and a second part, to be fixed inside.

The first part comprises a first gripping element, which can be gripped by the user, which is fixed to a first face of a leaf by means of a first fastening member which houses a key-operated cylinder of a lock.

Inside the gripping element is housed the latch of the lock, which is connected to the cylinder for being actuated.

These traditional handles generally comprise a second gripping element which is fixed to the second face of the leaf by means of a second fastening member (13), which incorporates a knob element which is connected to the latch for actuating it.

It is possible, by using the lock, from the outside, or by using the knob element, from the inside, to block the leaf in the closed position, by means of the latch, or to unblock it to open the door.

The cylinder is fixed to the first support by means of screws which are accessible through an opening of the first support which, when the handle is fixed to the door, is closed by the leaf.

This prevents dismantling of the lock from the outside of the door, which would enable the door to be opened without possessing the key to actuate the cylinder.

A drawback of this traditional solution is that, in order to change the cylinder, it is necessary to completely dismantle the handle from the door in order to disassemble certain parts and components.

The drawback underpinning this invention is to make the dismantling and assembly of the cylinder easier, without compromising the security of the handle.

The main aim of the invention is to make a handle assembly with lock, particularly for a glass leaf, which offers a solution to this problem by overcoming the above-described drawbacks of the traditional handles.

Within the scope of such a task, it is the aim of the present invention to propose a handle assembly with lock, particularly for a glass leaf, which allows a cylinder of the lock to be changed without requiring the dismantling of parts and components of the handle assembly.

Another aim of this invention is to make a handle assembly with lock, particularly for a glass leaf, which is structurally simple, fast to install and uninstall and at least as secure as traditional handles.

This task, as well as these and other aims which will emerge more fully below, are attained by a handle assembly with lock, particularly for a glass leaf.

Detailed features are included with the handle assembly with lock, particularly for a glass leaf.

Further features and advantages of the invention will emerge more fully from the description of a preferred but not exclusive embodiment of a handle assembly with lock, particularly for a glass leaf, illustrated by way of non-limiting example in the accompanying drawings, in which.

Figure 1:
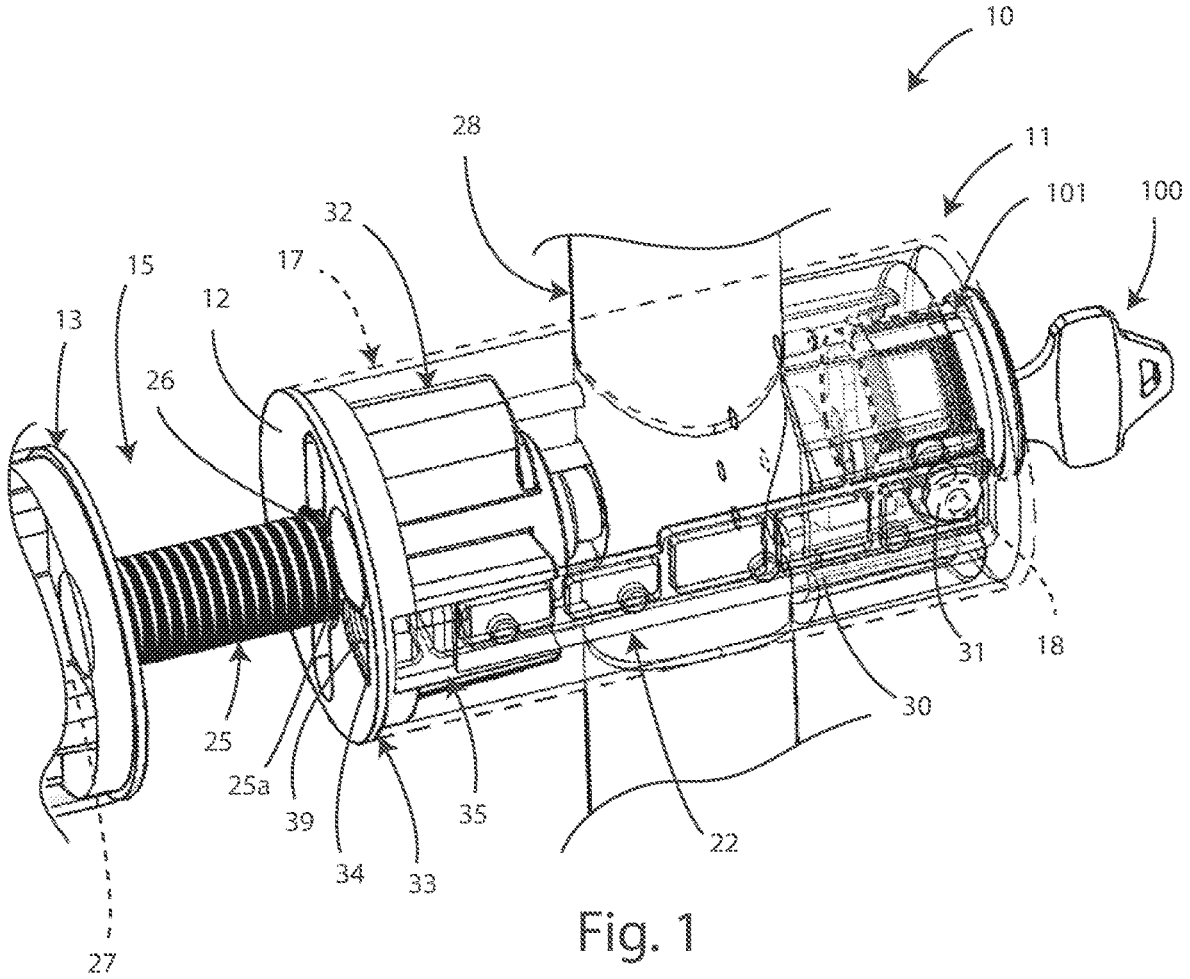
FIG. 1 illustrates a perspective view, with some parts transparent to better illustrate others, of a handle assembly with lock, particularly for a glass leaf, according to the invention.
Figure 2:
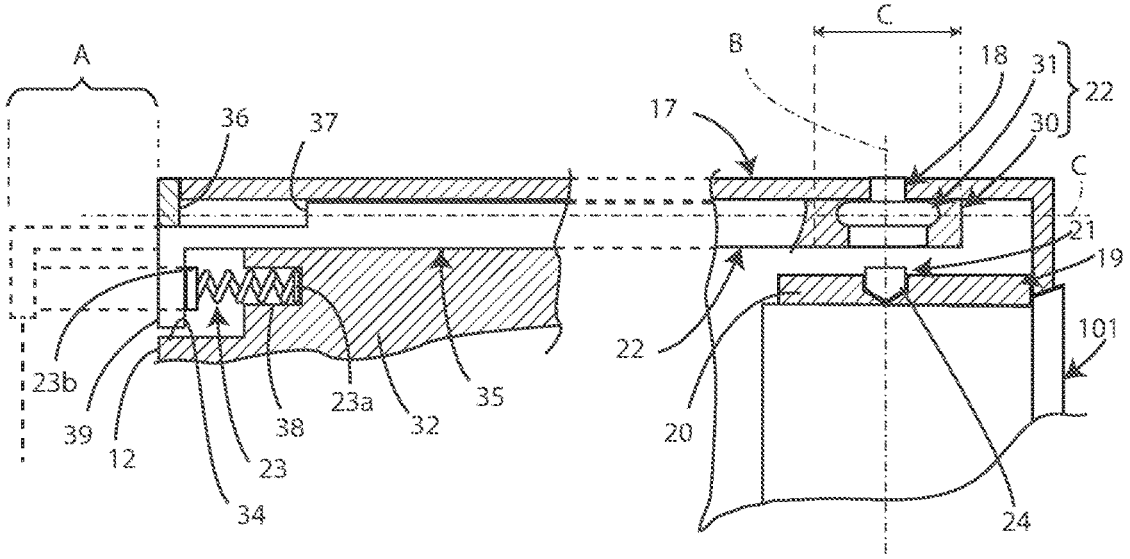
FIG. 2 illustrates a simplified diagram of a section of a first fastening member of the handle assembly of FIG. 1.
Figure 3A:
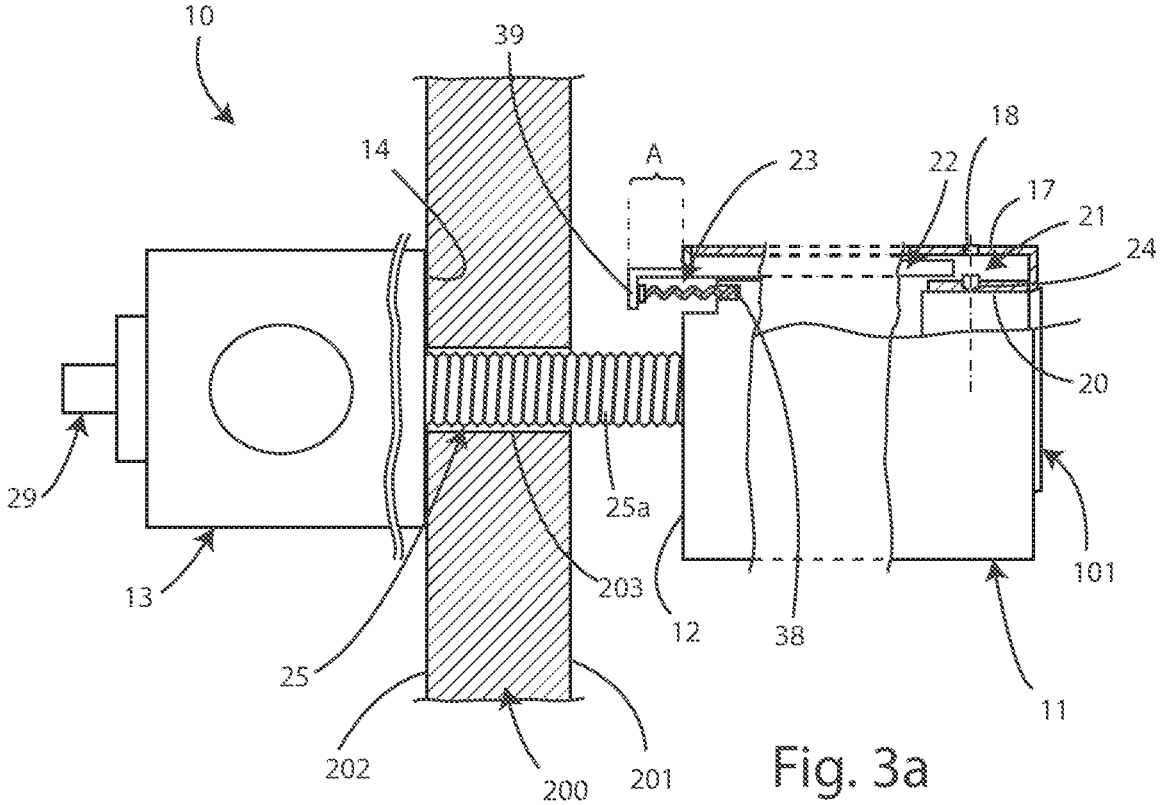
Figure 3B:
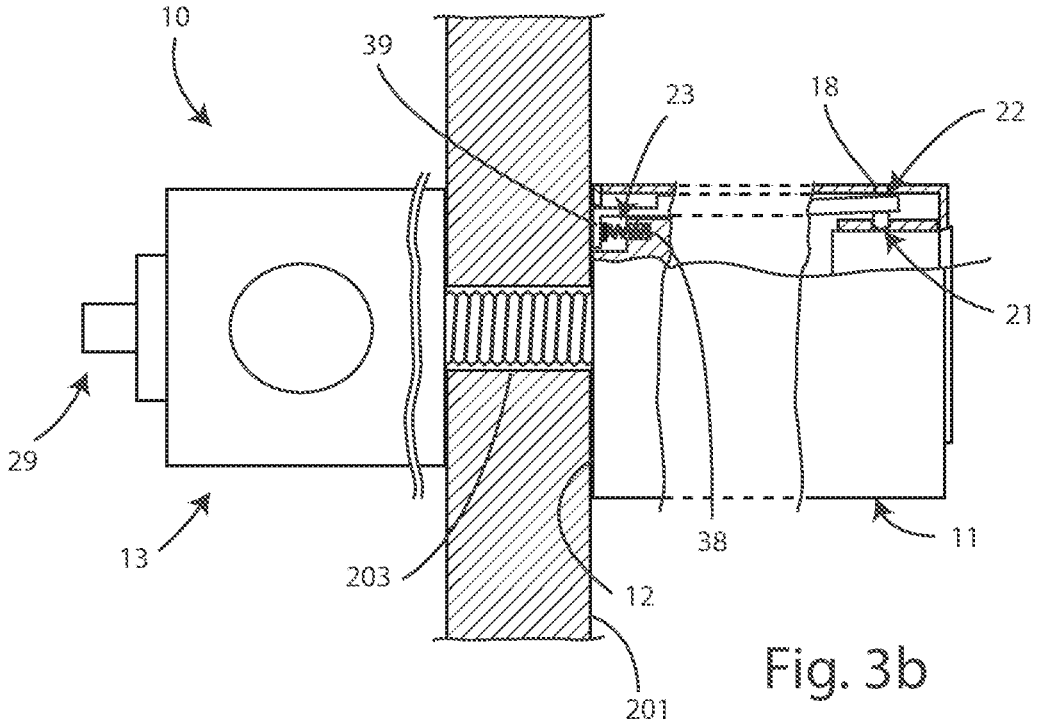
Figure 4:
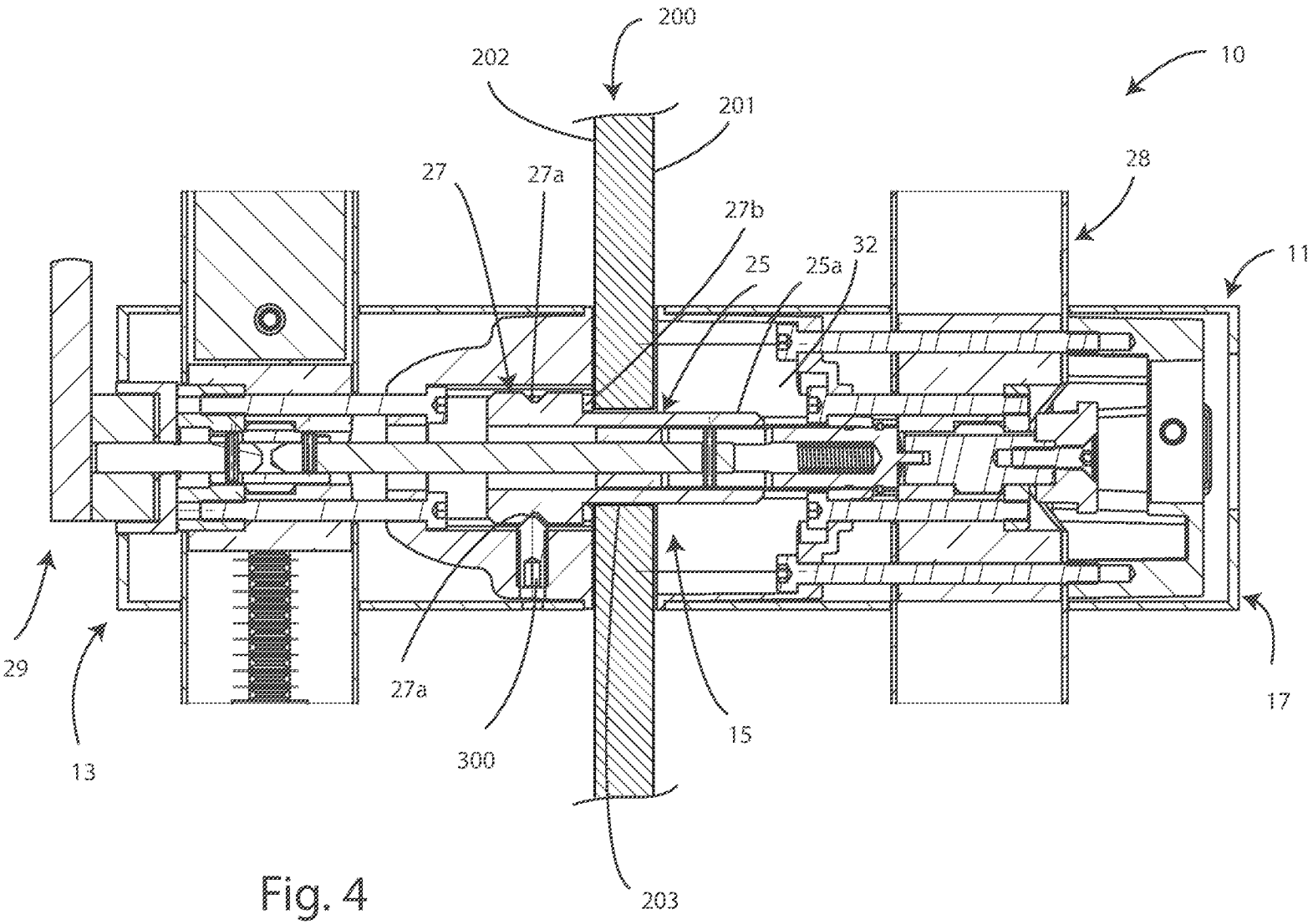

FIGS. 3*a* and 3*b* illustrate a plan view from below, with some parts in cross section, of a diagram of the handle assembly of FIG. 1;

FIG. 4 illustrates a longitudinal cross section of the handle assembly according to the invention.

With particular reference to the above-mentioned drawings, the numeral 10 denotes in its entirety a handle assembly with lock 100, particularly for a glass leaf 200, comprising:

- a first fastening member 11 having a first abutment face 12 designed to make contact with a first face 201 of a leaf 200 of a door;
- a second fastening member 13 having a first abutment face 14 designed to make contact with a second face 202 of the leaf 200;
- connecting means 15 designed to mutually connect the first fastening member 11 and the second fastening member 13 using a through hole 203 which passes through the leaf 200.

The connecting means 15 are configured for being actuated for moving the first fastening member 11 and the second fastening member 13 mutually towards and away from each other, for fixing the handle assembly 10 to the leaf 200 or for removing it from the latter, respectively.

The handle assembly 10 according to this invention has a peculiarity in that the first fastening member 11 comprises:

- a casing 17 equipped with an operating opening 18;
- a housing 19 positioned in the casing 17 and having a seat 20 which can be engaged by a cylinder 101 of the lock 100;
- a closing element 22 connected to the housing 19 in such a way as to be movable with respect to the latter between a closed position and an open position;
- elastic means 23 designed to counteract the movement of the closing element 22 from the open position to the closed position.

The housing 19 is also equipped with locking means 21 which can be actuated by locking the cylinder 101 in the seat 20 or by freeing it with respect to the latter.

The locking means 21 face the operating opening 18 for being actuated through the latter from the outside of the casing 17.

In the closed position, the closing element 22 does not protrude from the first abutment face 12 and it is interposed between the operating opening 18 and the locking means 21 for preventing the actuation of the latter from the outside of the casing 17.

In the open position the closing element 22 protrudes from the first abutment face 12 and it is not interposed between the operating opening 18 and the locking means 21 for allowing the actuation of the latter from the outside of the casing 17.

Operationally, in order to join the fastening members 11 and 13 to the leaf 200, the connecting means 15 are inserted through the through hole 203 of the leaf 200 and are engaged with each of the fastening members 11 and 13 which are positioned on opposite sides of the leaf 200. The actuation of the connecting means 15 determines the mutual positioning of the fastening members 11 and 13 to the leaf 200.

More specifically, in order for the first fastening member 11 to make with the leaf 200, the first abutment face 12 is adhered to the first face 201 of the leaf 200.

By doing this, the protruding portion A of the closing element 22, which protrudes from the abutment face 12, enters firstly into contact with the first face 201 of the leaf 200 and, as the abutment face 12 is moved close to the first face 201, the closing element 22 moves from the open position towards the closed position being forced inside the first fastening member 11 in contrast to the action of the elastic means 23.

When the abutment face 12 lies on the first face 201, the closing element 22 is completely inside the first fastening member 11 and, in particular, interposes between the operating opening 18 and the locking means 21 in such a way that their actuation, through the operating opening 18, is prevented.

In this way, once the fastening members 11 and 13 are blocked to the leaf 200, it is not possible to access the locking means 21 and it is therefore not possible to remove the cylinder 101 of the first fastening member 11.

The connecting means 15 are advantageously configured in such a way that when the fastening members 11 and 13 are fixed to the leaf 200, the connecting means can be actuated solely by acting from the side of the leaf of the second fastening member 13.

It can therefore be understood how, in order to remove the cylinder 101 from the first fastening member 11 it will be sufficient to:

- act on the connecting means 15, through the second fastening member 13, for spacing the abutment face 12 of the first fastening member 11 from the first face 201 of the leaf 200, as much as is necessary to allow the pushing of the closing element 22 to the open position by the elastic means 23;
- act on the locking means 21 through the operating hole 18 for freeing the cylinder 101 from the housing 19;
- extract the cylinder 101 from the housing 19.

It will not therefore be necessary to completely dismantle the handle assembly 10 from the leaf 200 but only to space the first fastening member 11 from the first face 201 of the leaf 200 by a distance sufficient for the closing element 22 to be moved to the open position so as to make access possible to the locking means 21 through the operating opening 18.

On the other hand, the locking means 21, when the handle assembly 10 is installed on the leaf 200, can be actuated solely from the side of the second fastening member 13 and, therefore, it is necessary for the leaf 200 to be open in order to be able to access both of its sides.

In this way, if the leaf is closed by the lock 100, the handle assembly 10 cannot be removed from the leaf 200 without having a key to open the lock 100 and thereby access the second fastening member 13 to open it, for example by removing the knob 29, and thereby having access to the connecting means 15 for actuating it.

For example, the connecting means can comprise a threaded, tubular rod 25, which has a first end 25*a* which can be screwed into a first lead nut 26 provided in the first fastening member 11 and a second end equipped with a head 27 with an annular hollow 27*a* which can be inserted in the second fastening member 13.

Advantageously, the head 27 has a shoulder 27*b* designed to make contact with the second face 202 of the leaf 200.

The threaded rod 25 advantageously has a second end configured for being screwed in the first fastening member 11.

The first fastening member 11 advantageously carries a hollow rod 28 in which is slidably housed a latch of the lock 100, in a traditional fashion.

The cylinder 101 is mechanically connected to the latch to actuate it, for example by means of a rack and pinion transmission, or in another traditional manner, not illustrated or described further.

The second fastening member 13 advantageously supports in a rotatable fashion a knob 29 which is connected to the latch, for actuating it, by a drive which advantageously passes through the threaded rod 25 and is advantageously connected to the pinion of the above-mentioned rack and pinion transmission.

The second fastening member 13 can preferably be connected to the head 27 and disconnected from the latter.

Advantageously, in particular, the second fastening member 13 can be fixed to the head 27 by a grub screw 300, so as to be able to remove the second fastening member 13 which is advantageously configured in such a way that, following the disengagement of the grub screw 300 from the annular hollow 27*a*, it can be removed from the head 27 to render it accessible and, therefore, render the threaded rod 25 unscrewable from the second fastening member 11.

Advantageously, the housing 19 has a threaded hole 24 facing in the seat 20.

Preferably, the locking means 21 comprise a grub screw which can be screwed in the threaded hole 24 for engaging the cylinder 101 and blocking it in the seat 20.

According to the embodiment shown by way of a non-limiting example in the accompanying drawings, the locking means 21 consist in said grub screw, so, for simplicity of description, the grub screw will be indicated hereafter and in the accompanying drawings with the same numerical reference 21 as the locking means.

The closing element 22 advantageously comprises a main body 30 and an anti-drilling element 31 which is coupled to the main body 30 in a rotatable fashion according to an axis of rotation B.

In the closed position, the anti-drilling element 31 is interposed between the operating opening 18 and the locking means 21.

The closing element 22 is also preferably configured in such a way that, when it is in the closed position, the axis of rotation B of the anti-drilling element 31 passes through the operating opening 18.

In this way, the handle assembly 10 is particularly secure since even if the bit of a drill were inserted through the operating opening 18 for drilling the closing element 22 and, thereby, access the locking means 21, the drill bit would enter into contact with the anti-drilling element 31 which would rotate as one with it, when actuated, preventing the drilling.

In a preferred embodiment, due to its constructional simplicity, the closing element 22 is advantageously slidable along an operating direction C with respect to the housing 19 between the open position and the closed position.

The first fastening member 11 advantageously comprises a core 32 to which is fixed the casing 17 and which has a flat wall 33 which defines the first abutment face 12.

The core 32 has a guide 35 which extends in the operating direction C which is substantially perpendicular to the wall 33.

Preferably, the closing element 22 is coupled to the guide 35 in such a way as to slide along the operating direction C to pass from the closed position to the open position. The wall 33 has a passage opening 34, aligned with the guide 35 with respect to the operating direction C in such a way that, during the passage from the closed position to the open position, the closing element 22 extends through the passage opening 34 to protrude with respect to the first abutment face 12.

The first fastening member 11 and preferably the casing 17, or the core 32, comprises a stop 36 in the guide 35 and the closing element 22 comprises a shoulder 37 aligned with the stop 36 along the operating direction C.

The stop 36 and the shoulder 37 are positioned in such a way that the shoulder 37 engages the stop 36 when the closing element 22 is in the open position, for limiting the extension of the closing element 22 from the guide 35.

The elastic means 23 advantageously comprise at least one helical compression spring having a first end which engages a recess 38 present in the core 32 and a second end 23*b* which engages a terminal 39 of the closing element 22.

The spring extends substantially parallel to the operating direction C.

The closing element 22 preferably has a terminal 39 which extends in a direction substantially perpendicular to the operating direction C in such a way as to face the recess 38.

The terminal 39 is advantageously engaged by a second end (23*b*) of the helical spring.

The helical spring preferably being configured in such a way that when the closing element 22 is in the closed position it is more compressed than when the closing element 22 is in the open position.

It has therefore been shown how a handle assembly 10 according to the invention achieves the set aims and objectives.

The invention as it is conceived is susceptible to numerous modifications and variants, all falling within the scope of protection of the appended claims.

Further, all the details can be replaced by other technically-equivalent elements.

In practice, the materials used, as well as the contingent forms and dimensions, can be varied according to the contingent requirements and the state of the art.

Where the constructional characteristics and the technical characteristics mentioned in the following claims are followed by signs or reference numbers, the signs or reference numbers have been used only with the aim of increasing the intelligibility of the claims themselves and, consequently, they do not constitute in any way a limitation to the interpretation of each element identified, purely by way of example, by the signs or reference numerals.

The invention claimed is:

1. A handle assembly (10) with lock (100), particularly for a glass leaf (200) comprising a first fastening member (11) having a first abutment face (12) apt to encounter against a first face (201) of a leaf (200) of a door;

a second fastening member (13) having a second abutment face (14) apt to encounter against the second face (202) of the leaf (200);

connecting means (15) apt for mutually connecting said first fastening member (11) and said second fastening member (13) by means of a through hole (203) which passes through the leaf (200); said connecting means (15) being configured to be operated, to mutually draw near or distance said first fastening member (11) and said second fastening member (13), to fix said handle assembly (10) to the leaf (200) or to remove it from the latter, respectively; where said connecting means (15) are configured in such a way that, following mounting of said handle assembly (10) on the leaf (200), they are exclusively operable, acting on the side of the leaf (200) engaged by said second fastening member (13);

said handle assembly (10) being characterized in that said first fastening member (11) comprises:

a casing (17) equipped with an operating opening (18);

a housing (19) located in said casing (17) and having a seat (20) engageable by a cylinder (101) of said lock (100); said housing (19) being further provided with locking means (21) operable to lock said cylinder (101) in said seat (20) or to free it with respect to the latter; said locking means (21) faces said operating opening (18) to be operated through the latter from the outside of said casing (17);

a closing element (22) connected to said housing (19) in a way movable with respect to the latter between a closed position and an open position;

elastic means (23) adapted to counteract the movement of said closing element (22) from said open position to said closed position;

where, in said closed position, said closing element (22) does not protrude from said first abutment face (12) and is interposed between said operating opening (18) and said locking means (21) to prevent the actuation of the latter from the outside of said casing (17); where, in said open position, said closing element (22) protrudes from said first abutment face (12) and is not interposed between said operating opening (18) and said locking means (21) to allow the actuation of the latter from the outside of said casing (17).

2. The handle assembly (10) according to claim 1 characterized in that said housing (19) has a threaded hole (24) facing said seat (20); said locking means (21) comprising a grub screw in said threaded hole (24) for engaging said cylinder (101) and locking it in said seat (20).

3. The handle assembly (10) according to claim 1, characterized in that said closing element (22) comprises a main body (30) and an anti-drilling element (31) which is coupled to said main body (30) in a rotatable way according to a rotation axis (B); where, in said closed position, said anti-drilling element (31) is placed between said operating opening (18) and said locking means (21); said closing element (22) being configured in such a way that, when it is in said closed position, said rotation axis (B) passes through said operating opening (18).

4. The handle assembly (10) according to claim 1, characterized in that said closing element (22) is slidable along an operating direction (C) with respect to said housing (19) between said open position and said closed position.

5. The handle assembly (10) according to claim 4 characterized in that said first fastening member (11) comprises a core (32) to which said casing (17) is fixed and which has a flat wall (33) which defines said first abutment face (12); said core (32) having a guide (35) extending in said operating direction (C) which is substantially perpendicular to said wall (33); said closing element (22) being coupled to said guide (35) so as to slide along said operating direction (C) to pass between said closed position and said open position; said wall (33) having a passage opening (34), aligned with said guide (35) with respect to said operating direction (C) in such a way that, in the passage from said closed position to said open position, said closing element (22) extends through said passage opening (34) to project with respect to said first abutment face (12).

6. The handle assembly (10) according to claim 5 characterized in that said first fastening member (11) comprises a stop (36) in said guide (35) and said closing element (22) comprises a shoulder (37) aligned with said stop (36) along said operating direction (C); said stop (36) and said shoulder (37) being positioned in such a way that said shoulder (37) engages said stop (36) when said closing element (22) is in said open position, to prevent limiting the extension of said closing element (22) from said guide (35).

7. The handle assembly (10) according to claim 5, characterized in that said elastic means (23) comprise at least one compression helical spring having a first end (23*a*) which engages a recess (38) present from said core (32) and a second end (23*b*) which engages a terminal (39) of said closing element (22); said spring extending substantially parallel to said operating direction (C).

8. The handle assembly (10) according to claim 7 characterized in that said closing element (22) has a terminal (39) extending in a direction substantially perpendicular to said operating direction (C) so as to face said recess (38); said terminal (39) being engaged by a second end (23*b*) of said at least one helical spring; said helical spring being configured in such a way that when said closing element (22) is in said closed position it is more compressed than when said closing element (22) is in said open position.

* * * * *